US005968289A

United States Patent [19]

Sakurada et al.

[11] Patent Number: 5,968,289

[45] Date of Patent: Oct. 19, 1999

[54] PERMANENT MAGNETIC MATERIAL AND BOND MAGNET

[75] Inventors: Shinya Sakurada, Tokyo; Tomohisa Arai; Keisuke Hashimoto, both of Yokohama; Takahiro Hirai, Kamakura, all of Japan

[73] Assignee: Kabushiki Kaisha Toshiba, Kawasaki, Japan

[21] Appl. No.: 08/984,019

[22] Filed: Dec. 3, 1997

[30] Foreign Application Priority Data

Dec. 5, 1996 [JP] Japan ..... 8-325276

[51] Int. Cl.[6] ..... H01F 1/04

[52] U.S. Cl. ..... 148/302; 420/83; 420/121; 252/62.54

[58] Field of Search ..... 148/302; 420/83, 420/121; 252/62.54

[56] References Cited

U.S. PATENT DOCUMENTS

| | | | |
|---|---|---|---|
| 4,770,702 | 9/1988 | Ishigaki et al. | 75/244 |
| 4,878,964 | 11/1989 | Mizoguchi et al. | 148/302 |
| 5,125,990 | 6/1992 | Iwasaki et al. | 148/302 |
| 5,162,064 | 11/1992 | Kim et al. | 148/302 |
| 5,186,766 | 2/1993 | Iriyama et al. | 148/301 |
| 5,466,308 | 11/1995 | Fujimura et al. | 148/302 |
| 5,482,573 | 1/1996 | Sakurada et al. | 148/301 |
| 5,716,462 | 2/1998 | Sakurada et al. | 148/302 |

FOREIGN PATENT DOCUMENTS

| | | |
|---|---|---|
| 5-82041 | 11/1993 | Japan . |
| 8-316018 | 11/1996 | Japan . |
| 9-74006 | 3/1997 | Japan . |

*Primary Examiner*—John Sheehan
*Attorney, Agent, or Firm*—Foley & Lardner

[57] ABSTRACT

A permanent magnetic material of the present invention has a $TbCu_7$ phase as the principal phase and high magnetic characteristics with an extremely small variation among the values. This permanent magnetic material is expressed in a general formula:

$$R1_xR2_yA_zO_uB_vM_{100-x-y-z-u-v}$$

wherein R1 is at least one element selected from the rare earth elements including Y, R2 is at least one element selected from Zr, Hf and Sc, A is at least one element selected from hydrogen, nitrogen, carbon and phosphorus, M is at least one element selected from Fe and Co, x, y, z, u and v are atomic percent individually defined as $2 \leqq x$, $0.01 \leqq y$, $4 \leqq x+y \leqq 20$, $0.001 \leqq z \leqq 10$, $0.01 \leqq u \leqq 2$, $0 < v \leqq 10$, and a principal phase has a $TbCu_7$ crystal structure.

13 Claims, No Drawings

PERMANENT MAGNETIC MATERIAL AND BOND MAGNET

BACKGROUND OF THE INVENTION

The present invention relates to a permanent magnetic material and a bond magnet.

As conventional high performance rare earth permanent magnets such as Sm-Co-based and Nd-Fe-B-based magnets are known and the mass production thereof is under way. These magnets contain Fe or Co at high concentrations and they contribute to promotion in the level of the saturation magnetic flux density. These magnets also contain rare earth elements, and the rare earth elements bring about a very large magnetic anisotropy derived from the behavior of 4f electrons in the crystal field. As a result, the coersive force is increased, and a magnet of a high performance is realized. Such a high performance magnets are mainly used in electric appliances such as a loudspeaker, a motor, and a measuring device.

Recently, in order to meet the increasing demand for smaller electric appliances, a higher-performance permanent magnet by improving the maximum magnetic energy product is required.

On the other hand, Japanese Patent Application Laid Open (JP-A) No. 6-172936 discloses permanent magnetic material having a $TbCu_7$ phase as the principal phase. The permanent magnetic material having a $TbCu_7$ phase as the principal phase has excellent magnetic characteristics with a high saturation magnetic flux density. However, in the case an interstitial element such as H, N, C and P is contained in the above-mentioned permanent magnetic material, the magnetic characteristics greatly vary depending on the production conditions. The great variation of the magnetic characteristics results in a serious problem of the decline of the magnetic characteristics by offsetting the variation of the magnetic characteristics in the industrial mass production.

BRIEF SUMMARY OF THE INVENTION

An object of the present invention is to provide a permanent magnetic material having a $TbCu_7$ phase as the principal phase with high magnetic characteristics with an extremely small variation among the values.

Another object of the present invention is to provide a stable bond magnet containing the above-mentioned permanent magnetic material and a binder, having high magnetic characteristics.

The present invention provides a permanent magnetic material which is expressed in a general formula:

$$R1_xR2_yA_zO_uB_vM_{100-x-y-z-u-v}$$

wherein R1 is at least one element selected from the rare earth elements including Y, R2 is at least one element selected from Zr, Hf and Sc, A is at least one element selected from hydrogen, nitrogen, carbon and phosphorus, M is at least one element selected from Fe and Co, x, y, z, u and v are atomic percent individually defined as $2 \leqq x$, $0.01 \leqq y$, $4 \leqq x+y \leqq 20$, $0.001 \leqq z \leqq 10$, $0.01 \leqq u \leqq 2$, $0 < v \leqq 10$, and a principal phase has a $TbCu_7$ crystal structure.

Another present invention provides a bond magnet comprising:

permanent magnetic material expressed in a general formula:

$$R1_xR2_yA_zO_uB_vM_{100-x-y-z-u-v}$$

wherein R1 is at least one element selected from the rare earth elements including Y, R2 is at least one element selected from Zr, Hf and Sc, A is at least one element selected from hydrogen, nitrogen, carbon and phosphorus, M is at least one element selected from Fe and Co, x, y, z, u and v are atomic percent individually defined as $2 \leqq x$, $0.01 \leqq y$, $4 \leqq x+y \leqq 20$, $0.001 \leqq z \leqq 10$, $0.01 \leqq u \leqq 2$, $0 < v \leqq 10$, and a principal phase has a $TbCu_7$ crystal structure; and a binder.

DETAILED DESCRIPTION OF THE INVENTION

Hereinafter the present invention will be explained in detail.

A permanent magnetic material of the present invention is expressed in a general formula:

$$R1_xR2_yA_zO_uB_vM_{100-x-y-z-u-v}$$

wherein R1 is at least one element selected from the rare earth elements including Y, R2 is at least one element selected from Zr, Hf and Sc, A is at least one element selected from hydrogen, nitrogen, carbon and phosphate, M is at least one element selected from Fe and Co, x, y, z, u and v are atomic percent individually defined as $2 \leqq x$, $0.01 \leqq y$, $4 \leqq x+y \leqq 20$, $0.001 \leqq z \leqq 10$, $0.01 \leqq u \leqq 2$, $0 < v \leqq 10$, and the principal phase has a $TbCu_7$ crystal structure.

The term "principal phase" noted above denotes one of the crystal phases and amorphous phases in the compound which occupies the largest volume. The principal phase having a $TbCu_7$ crystal structure is responsible for the magnetic characteristics. Therefore, since the characteristics of the principal phase cannot be performed with a small content ratio of the principal phase in the compound of the present invention, it is preferable that the content ratio of the principal phase is at least 50% by volume in the compound.

The function of each component of the permanent magnetic material of the above-mentioned general formula and the reason of each content ratio will be explained in detail.

(1-1) element R1

Examples of elements R1 are rare earth elements include La, Ce, Pr, Nd, Sm, Eu, Gd, Tb, Dy, Ho, Er, Tm, Lu and Y. They are used alone or in combination of two or more. The elements R1 can provide a large magnetic anisotropy and apply a high coersive force to the above-mentioned permanent magnetic materials. In particular, it is preferable that 50 atomic % or more of the element R1 is Sm. In this case, it is preferable that the remainder excluding Sm is at least one element selected from Pr, Nd and Ce.

If the amount of the element R1 contained in the magnetic material is smaller than 2 atomic %, the magnetic anisotropy significantly declines. Therefore, it is difficult to obtain a permanent magnetic material having a large coersive force. On the other hand, the magnetization degree of a permanent magnetic material lowers with an excessive amount of the element R1. Therefore, the content of the element R1 is preferably $4 \leqq x \leqq 16$, more preferably $6 \leqq x \leqq 12$.

(1-2) element R2

At least one selected from the group consisting of Zr, Hf and Sc can be used as an element R2. Since the element R2 occupies the rare earth site of mainly the principal phase so as to reduce the average atomic radius of the rare earth site, the Fe and Co concentration in the $TbCu_7$ phase as the principal phase can be increased. Furthermore, since the element R2 can fine the crystal grains of the $TbCu_7$ phase, this is advantageous in improving the coersive force and the residual magnetization. The content y of the element R2 is preferably $0.1 \leqq y$, more preferably $1 \leqq y \leqq 3$.

If the sum of the element R1 and element R2 in the magnetic material is less than 4 atomic %, a large amount of α-Fe (Co) is formed in the magnetic material. Therefore, it is difficult to obtain a permanent magnetic material having a large coersive force. On the other hand, if the sum of the element R and element R2 in the magnetic material exceeds 20 atomic %, the magnetization of the permanent magnet material lowers. The sum of the element R1 and the element R2 (x+y) is more preferably $4 \leqq x+y \leqq 16$.

(1-3) element A

At least one element selected from the group consisting of H, N, C and P can be used as the element A. The element A exists mainly at an interstitial position. Compared with the case not containing the element A, it can improve the Curie temperature and the magnetic anisotropy. Above all, the improvement of the magnetic anisotropy is important in order to provide a large coersive force to a permanent magnetic material.

The element A can provide the effect with a small amount, however, on the other hand, α-Fe (Co) deposits considerably with more than 20 atomic %. The content z of the element A is preferably $2 \leqq z \leqq 20$, more preferably $5 \leqq z \leqq 10$.

(1-4) O (oxygen)

Oxygen is an element effective for obtaining a permanent magnetic material having stable magnetic characteristics with a good reproductivity according to the object of the present invention. If the amount of an oxygen in the magnetic material is less than 0.01 atomic %, it is difficult to perform the effect sufficiently. On the other hand, if the amount of the oxygen in the magnetic material exceeds 2 atomic %, the magnetic characteristics may deteriorate by the increase of the ratio of an oxide phase in the permanent magnetic material. The oxygen content u is more preferably $0.1 \leqq u \leqq 1.5$.

(1-5) B (boron)

Boron is an effective element for improving the residual magnetic flux density of a permanent magnetic material. If the amount of a boron in the magnetic material exceeds 10 atomic %, the magnetic characteristics of the permanent magnetic material may deteriorate due to significant generation of the $R_2Fe_{14}B$ phase. The boron content v is more preferably $0.01 \leqq v \leqq 4$, further preferably $0.1 \leqq v \leqq 3$.

(1-6) element M

At least one element selected from the group consisting of Fe and Co can be used as the element M. It can increase the saturated magnetic flux density of the permanent magnetic material. The increase of the saturated magnetic flux density contributes to the increase of the residual magnetic flux density. Accordingly, the maximum energy product increases as well. With 70 atomic % or more of the element M in the permanent magnetic material, the saturated magnetic flux density can be increased effectively. In order to further increase the saturated magnetic flux density, it is preferable that Fe accounts for 50% or more of the sum of the element M.

It is preferable that the element M is contained in the principal phase by 90 atomic % or more. With the element M concentration in the principal phase increased, the saturated magnetic flux density of the permanent magnetic material can be increased so as to further improve the magnetic characteristics. With an element M concentration of 90 atomic % or more, the above-mentioned effect can appear further significantly.

A part of the above-mentioned element M can be substituted by at least one element (element T) selected from the group consisting of Si, Ti, Al, Ge, Ga, V, Ta, Mo, Nb, Sn, Cr, W, Mn, Cu, Ag and Ni. By such a substitution by the element T, it is possible to increase the ratio of the principal phase in the permanent magnetic material or increase the ratio of the sum of the element M and the element T in the principal phase. Furthermore, it is also possible to increase the coersive force of the permanent magnetic material. However, by substituting the element M with the element T in a large amount, the saturated magnetic flux density may deteriorate. Therefore, the substitution amount of the element M by the element T is preferably 20 atomic % or less.

A permanent magnetic material of the present invention may contain an inevitable impurity.

In a permanent magnetic material of the present invention, it is preferable that the ratio c/a of the lattice constants a, c of the principal phase is 0.847 or more. With the c/a ratio increased, the saturated magnetic flux density of the permanent magnetic material can increase so as to improve the magnetic characteristics. The effect is particularly significant in a permanent magnetic material with the c/a ratio of 0.847 or more. The value of the c/a ratio can be controlled by the component ratio in the permanent magnetic material or the production method.

The production method of the above-mentioned permanent magnetic material will be explained in detail.

(2-1) An ingot containing an element T for substituting a part of the element M is prepared by the arc melting or the high frequency melting according to elements of predetermined amount and the need. The ingot is cut out into small pieces so as to be melted by the high frequency induction heating with a predetermined amount of boron (B), then sprayed onto a single roll rotating at a high speed for producing a rapid cooling thin ribbon. It is also possible to produce a rapid cooling thin ribbon with an ingot preliminarily containing boron.

As a rapid cooling process, a twin roll method, a rotating disk method or a gas atomize method can be used as well.

(2-2) A permanent magnetic material is produced by the mechanical alloying method or the mechanical grinding method where a mixture of component powders of a predetermined amount of R1, R2, B, M and optionally the element T for substituting a part of the element M is applied with the mechanical energy for obtaining an alloy by the solid phase reaction.

In the above-mentioned production method of a permanent magnetic material, it is preferable to have the rapid cooling process and the solid phase reaction process in an inert gas atmosphere such as Ar and He. By rapid cooling or solid phase reaction in the atmosphere, the permanent magnetic material can be produced without the risk of deteriorating the magnetic materials by an excessive oxidization.

The permanent magnetic material obtained by the above-mentioned method may be applied with a heat treatment at 300 to 1000° C. for 0.1 to 10 hours in an inert gas atmosphere such as Ar and He as needed. By the heat treatment, the magnetic characteristics such as the coersive force can be improved.

In the case N is included as the element A in the above-mentioned production method of a permanent magnetic material, the permanent magnetic material is produced by pulverizing the alloy material obtained by the above-mentioned (2-1) and (2-2) processes with a ball mill, a brown mill, a stamp mill or a jet mill to an average particle size of several μm to several hundred μm, and applying a heat treatment (nitriding treatment) to the alloy powders in a nitrogen gas atmosphere. However, since an alloy material produced by the mechanical alloying method or the mechanical grinding method as in the above-mentioned (2) method is powdery, the above-mentioned pulverizing process can be omitted.

It is preferable that the above-mentioned nitriding treatment is conducted at 200 to 700° C. in a nitrogen gas atmosphere of 0.001 to 100 atmospheric pressure. The nitriding treatment under the pressure and the temperature may be conducted for 0.1 to 300 hours.

As the atmosphere for the above-mentioned nitriding treatment, a nitrogen compound such as ammonia can be used in place of the nitrogen gas. By the use of ammonia, the nitriding reaction rate can be accelerated. In this case, it is possible to restrain the nitriding reaction rate by the use of a gas such as hydrogen and argon at the same time.

As a preliminary process of the above-mentioned nitriding process, it is possible to apply a heat treatment at 100 to 700° C. in a hydrogen gas atmosphere of 0.001 to 100 atmospheric pressure or by the use of a gas mixture of a nitrogen gas and hydrogen for nitriding with a high efficiency.

The oxygen content of the permanent magnetic material can be controlled by adjusting the oxygen content in the melting furnace or the specimen container at the time of melting an alloy or the solid phase reaction in producing the ingot and applying the quenching treatment, the heat treatment in the inert gas atmosphere or in a vacuum, pulverization or the nitriding treatment. It is possible that the permanent magnetic material contains oxygen by a heat treatment of 100 to 400° C. in an oxygen-containing atmosphere. In this case, the oxygen content in the permanent magnetic material can be controlled by the particle size of the material powders, the temperature, the time and the oxygen concentration at the time of the heat treatment. Furthermore, in the case the alloy material obtained in the above-mentioned production process is powdery, the oxygen content of the permanent magnetic material can be controlled by adjusting the time for being exposed to an atmosphere between processes after pulverization.

The permanent magnetic material of the present invention heretofore explained is expressed in the above-mentioned general formula:

$$R1_xR2_yA_zO_uB_vM_{100-x-y-z-u-v}$$

wherein x, y, z, u and v represents a specific atomic percent, and the principal phase has a $TbCu_7$ crystal structure. By adding boron (B) in a permanent magnetic material as mentioned above, the magnetic characteristics such as the residual magnetic flux density can be improved significantly.

That is, in the case individual crystal grains behave independently in an isotropic permanent magnetic material, in general, the ratio (Br/Bs) of the residual magnetic flux density (Br) to the saturated magnetic flux density (Bs) does not exceed 0.5. However, in the case fined crystal grains bond by the exchange interaction via grain boundaries, the Br/Bs ratio of an isotropic permanent magnetic material may exceed 0.5.

Since the exchange interaction among crystal grains is enhanced in a permanent magnetic material according to the present invention represented by the above-mentioned general formula having a $TbCu_7$ phase as the principal phase and containing boron (B), the residual magnetic flux density can be improved. This is considered to be because of the boron behavior explained below. Boron is incorporated in a permanent magnetic material by entering in an interstitial position of the $TbCu_7$ phase or forming the grain boundary phase by bonding with an rare earth element or a transitional metal element. Such a boron incorporation into a permanent magnetic material effects the grain boundary structure such as a finer crystal grain boundary. Therefore, the exchange interaction among the crystal grains can be enhanced to realize the Br/Bs ratio exceeding 0.5, and the residual magnetic flux density of the permanent magnetic material can be improved.

As mentioned in the description of the related art, the magnetic characteristics may drastically vary depending on the production conditions in the case an interstitial element such as H, N, C and P is contained in the magnetic material. A cause of such a variation of the magnetic characteristics is the unevenness of the interstitial elements in the magnetic material. The magnetic characteristics can be stabilized by significantly restraining the variation of the magnetic characteristics by containing a predetermined amount of oxygen in a magnetic material as in the present invention.

That is, even though the function of oxygen in a permanent magnetic material is not clear, it is considered that a part of oxygen bonds with another magnetic material component to generate an oxide in the melting process or the pulverizing process in the production process of the permanent magnetic material and exists segregated at a crystal grain boundary or at the surface. Such an oxide is assumed to improve the stability of the magnetic characteristics of the permanent magnetic material by promoting the homogeneous dispersion of the above-mentioned interstitial element.

A bond magnet according to the present invention can be obtained by mixing the above-mentioned permanent magnetic material powders and a binder, and the compressed molding or the injection molding of the mixture.

A synthetic resin such as an epoxy resin and nylon can be used as the above-mentioned binder. In the case a thermosetting resin such as the epoxy resin is used as the synthetic resin, it is preferable to apply a cure treatment at 100 to 200° C. after the compressed molding. In the case a thermoplastic resin such as nylon is used as the synthetic resin, it is preferable to use the injection molding method.

A bond magnet having a high magnetic flux density can be obtained by aligning the crystal orientation of the alloy powders by applying a magnetic field.

It is also possible to produce a metal bond magnet by the use of a low melting point metal or a low melting point alloy as the binder. Examples of the low melting point metal include metals such as Al, Pb, Sn, Zn, Cu, and Mg. An alloy of these metals can be used as the above-mentioned alloy.

It is also possible to produce a permanent magnet by integrating the above-mentioned permanent magnetic powders as a high density molded product by the hot press or the hot isostatic press (HIP). A permanent magnet having a high magnetic flux density can be produced by aligning the alloy powder crystal orientation by applying a magnetic field. Further, a permanent magnet with the alloy powders oriented in the axis of easy magnetization direction can be produced by applying a plastic deformation processing with pressure at 300 to 700° C. after the above-mentioned pressing process.

Moreover, it is also possible to produce a permanent magnet by sintering the above-mentioned permanent magnetic material powders.

Since a bond magnet according to the present invention as heretofore explained has high magnetic characteristics as mentioned above and contains a permanent magnetic material with an extremely small variation, it has stable high magnetic characteristics.

Furthermore, the above-mentioned bond magnet can be applied as a part of a rotor or a stator of a motor. Examples of the motor include a spindle motor. The spindle motor comprises, for example, a cylindrical body comprising a bond magnet, a rotor comprising a disk fixed at an opening portion at one end of the cylindrical body, having a spindle projecting concentrically to the inside of the cylindrical body, and an electromagnet provided in the cylindrical body, pivoted by the spindle as well as supported by another supporting member but the cylindrical body. The cylindrical body comprising the bond magnet is divided into a plurality of arcs of a predetermined angle, having the N and S poles in the thickness direction by the polarization, arranged with the N and S poles of the adjacent arc portions alternately.

In the spindle motor of the above-mentioned configuration, the cylindrical body can rotate by switching the N and S poles of the electromagnet provided in the cylindrical body comprising the bond magnet by the magnetization function, and as a result, the spindle projecting from the disk fixed at the cylindrical body can rotate.

Since the motor like the above-mentioned spindle motor comprises a part of a rotor or a stator comprising a bond magnet having the above-mentioned stable high magnetic characteristics, a smaller configuration and a high performance can be achieved. Therefore, it can be utilized effectively as the driving source for a hard disk drive or a CD-ROM.

Hereinafter preferable embodiments of the present invention will be explained in detail.

(EXAMPLE 1 TO 5)

High purity materials of Sm, Pr, Nd, Ce, Zr, Hf, Co, Mo, Ga, Al, Ni, Cu, B, P and Fe were mixed, high-frequency melted in an argon atmosphere, and injected in molds so as to prepare 5 kinds of ingots. The ingots were placed in a nozzle made of quartz, melted by the high-frequency induction heating, sprayed onto a copper single roll having a 300 mm diameter, rotating at a peripheral speed of 45 m/s to prepare alloy thin ribbons. Then the alloy thin ribbons were applied with the heat treatment at 700° C. for 30 minutes in an argon atmosphere.

The generated phase in the each alloy thin ribbon after the heat treatment was examined by the X ray diffraction. As a result, all the diffraction peaks excluding fine α-Fe diffraction peaks can be indexed by a $TbCu_7$ type crystal structure of the hexagonal crystal system, with the $TbCu_7$ phase serving as the principal phase. Further, the result of the X-ray diffraction revealed that the lattice constant of the $TbCu_7$ phase was evaluated as a=0.4853 nm, c=0.4184 nm, and the lattice constant ratio c/a was 0.8621.

Then the above-mentioned alloy thin bands were pulverized with a ball mill so as to prepare alloy powders having an average particle size of 20 to 30 μm. 5 kinds of permanent magnetic materials were produced by applying a heat treatment to the alloy powders in an atmosphere at 150° C. for 10 minutes, and a heat treatment at 440° C. for 80 hours in a nitrogen gas atmosphere in a 150 atmospheric pressure.

Then 5 kinds of bond magnets were produced by adding 2% by weight of an epoxy resin to each of the permanent magnetic materials and mixing, compression molding at 1000 MPa, and curing at 150° C. for 2.5 hours.

In order to examine the reproductivity, the same compositions and the same production processes were repeated 5 times each for the production of each of the permanent magnetic materials and the bond magnets.

The powder X-ray diffraction was conducted for each of the permanent magnetic materials after the nitriding treatment to confirm that they have a $TbCu_7$ type crystal structure as the principal phase.

(Comparative Examples 1, 2)

Alloy powders having an average particle size of 20 to 30 μm were produced by the heat treatment of Sm-Pr-Nd-Zr-Co-Mo-B-Fe-based alloy thin ribbons like example 1 in an argon atmosphere at 700° C. for 30 minutes, and pulverizing with a ball mill. The alloy powders were processed in the method the same as examples 1 to 5 except that the heat treatment in the atmosphere was not applied or a heat treatment was applied at 300° C. for 10 minutes in the atmosphere so as to produce two kinds of permanent magnetic materials. Furthermore, two kinds of bond magnets were produced in the process the same as examples 1 to 5 with the produced permanent magnets.

In order to examine the reproductivity, the same compositions and the same production processes were repeated 5 times each for the production of each of the permanent magnetic materials and the bond magnets.

The powder X-ray diffraction was conducted for each of the permanent magnetic materials after the nitriding treatment to confirm that they have a $TbCu_7$ type crystal structure as the principal phase.

(Comparative Examples 3, 4)

Alloy powders having an average particle size of 20 to 30 μm were produced by the heat treatment of Sm-Ce-Nd-Zr-Co-Mo-B-Fe-based alloy thin ribbons like example 2 in an argon atmosphere at 700° C. for 30 minutes, and pulverizing with a ball mill. The alloy powders were processed in the method the same as examples 1 to 5 except that the heat treatment in the atmosphere was not applied or a heat treatment was applied at 300° C. for 10 minutes in the atmosphere so as to produce two kinds of permanent magnetic materials. Furthermore, two kinds of bond magnets were produced in the process the same as examples 1 to 5 with the produced permanent magnets.

In order to examine the reproductivity, the same compositions and the same production processes were repeated 5 times each for the production of each of the permanent magnetic materials and the bond magnets.

The powder X-ray diffraction was conducted for each of the permanent magnetic materials after the nitriding treatment to confirm that they have a $TbCu_7$ crystal structure as the principal phase.

The composition of the permanent magnets and the magnetic characteristics (coersive force, residual magnetic flux density and maximum energy product) at a room temperature of the bond magnets obtained in examples 1 to 5 and comparative examples 1 to 4 were measured. Results are shown in Tables 1 to 3.

TABLE 1

| | Permanent magnetic material composition (bal. denotes balance) | Coersive force (kA/m) | Residual magnetic flux density (T) | Maximum energy product ($kJ/m^3$) |
|---|---|---|---|---|
| Example 1-1 | $Sm_5\ Pr_1\ Nd_2\ Zr_2\ Co_7\ Mo_1\ B_{1.5}\ N_7\ O_{1.3}\ Fe_{bal.}$ | 605 | 0.70 | 76 |
| Example 1-2 | $Sm_5\ Pr_1\ Nd_2\ Zr_2\ Co_7\ Mo_1\ B_{1.5}\ N_8\ O_{1.2}\ Fe_{bal.}$ | 603 | 0.71 | 77 |
| Example 1-3 | $Sm_5\ Pr_1\ Nd_2\ Zr_2\ Co_7\ Mo_1\ B_{1.5}\ N_7\ O_{1.2}\ Fe_{bal.}$ | 600 | 0.70 | 75 |

TABLE 1-continued

| | Permanent magnetic material composition (bal. denotes balance) | Coersive force (kA/m) | Residual magnetic flux density (T) | Maximum energy product ($kJ/m^3$) |
|---|---|---|---|---|
| Example 1-4 | $Sm_5\ Pr_1\ Nd_2\ Zr_2\ Co_7\ Mo_1\ B_{1.5}\ N_8\ O_{1.0}\ Fe_{bal.}$ | 608 | 0.68 | 75 |
| Example 1-5 | $Sm_5\ Pr_1\ Nd_2\ Zr_2\ Co_7\ Mo_1\ B_{1.5}\ N_8\ O_{0.9}\ Fe_{bal.}$ | 605 | 0.71 | 86 |
| Comparative Example 1-1 | $Sm_5\ Pr_1\ Nd_2\ Zr_2\ Co_7\ Mo_1\ B_{1.5}\ N_7\ O_{0.009}\ Fe_{bal.}$ | 607 | 0.67 | 73 |
| Comparative Example 1-2 | $Sm_5\ Pr_1\ Nd_2\ Zr_2\ Co_7\ Mo_1\ B_{1.5}\ N_7\ O_{0.006}\ Fe_{bal.}$ | 575 | 0.66 | 59 |
| Comparative Example 1-3 | $Sm_5\ Pr_1\ Nd_2\ Zr_2\ Co_7\ Mo_1\ B_{1.5}\ N_8\ O_{0.008}\ Fe_{bal.}$ | 600 | 0.71 | 75 |
| Comparative Example 1-4 | $Sm_5\ Pr_1\ Nd_2\ Zr_2\ Co_7\ Mo_1\ B_{1.5}\ N_7\ O_{0.009}\ Fe_{bal.}$ | 515 | 0.67 | 55 |
| Comparative Example 1-5 | $Sm_5\ Pr_1\ Nd_2\ Zr_2\ Co_7\ Mo_1\ B_{1.5}\ N_7\ O_{0.007}\ Fe_{bal.}$ | 598 | 0.70 | 73 |
| Comparative Example 2-1 | $Sm_5\ Pr_1\ Nd_2\ Zr_2\ Co_7\ Mo_1\ B_{1.4}\ N_7\ O_{5.2}\ Fe_{bal.}$ | 452 | 0.55 | 43 |
| Comparative Example 2-2 | $Sm_5\ Pr_1\ Nd_2\ Zr_2\ Co_7\ Mo_1\ B_{1.4}\ N_8\ O_{6.5}\ Fe_{bal.}$ | 388 | 0.44 | 20 |
| Comparative Example 2-3 | $Sm_5\ Pr_1\ Nd_2\ Zr_2\ Co_7\ Mo_1\ B_{1.4}\ N_8\ O_{5.1}\ Fe_{bal.}$ | 505 | 0.50 | 25 |
| Comparative Example 2-4 | $Sm_5\ Pr_1\ Nd_2\ Zr_2\ Co_7\ Mo_1\ B_{1.4}\ N_8\ O_{5.5}\ Fe_{bal.}$ | 390 | 0.40 | 21 |
| Comparative Example 2-5 | $Sm_5\ Pr_1\ Nd_2\ Zr_2\ Co_7\ Mo_1\ B_{1.4}\ N_7\ O_{6.5}\ Fe_{bal.}$ | 429 | 0.45 | 18 |

TABLE 2

| | Permanent magnetic material composition (bal. denotes balance) | Coersive force (kA/m) | Residual magnetic flux density (T) | Maximum energy product ($kJ/m^3$) |
|---|---|---|---|---|
| Example 2-1 | $Sm_6\ Ce_2\ Nd_1\ Zr_2\ Co_{18}B_{1.8}\ N_8\ O_{1.1}\ Fe_{bal.}$ | 702 | 0.66 | 79 |
| Example 2-2 | $Sm_6\ Ce_2\ Nd_1\ Zr_2\ Co_{18}B_{1.8}\ N_8\ O_{1.0}\ Fe_{bal.}$ | 700 | 0.68 | 79 |
| Example 2-3 | $Sm_6\ Ce_2\ Nd_1\ Zr_2\ Co_{18}B_{1.8}\ N_8\ O_{0.8}\ Fe_{bal.}$ | 708 | 0.65 | 78 |
| Example 2-4 | $Sm_6\ Ce_2\ Nd_1\ Zr_2\ Co_{18}B_{1.8}\ N_8\ O_{0.6}\ Fe_{bal.}$ | 705 | 0.67 | 77 |
| Example 2-5 | $Sm_6\ Ce_2\ Nd_1\ Zr_2\ Co_{18}B_{1.8}\ N_8\ O_{1.0}\ Fe_{bal.}$ | 699 | 0.68 | 76 |
| Comparative Example 3-1 | $Sm_6\ Ce_2\ Nd_1\ Zr_2\ Co_{18}B_{1.8}\ N_7\ O_{0.007}\ Fe_{bal.}$ | 655 | 0.65 | 58 |
| Comparative Example 3-2 | $Sm_6\ Ce_2\ Nd_1\ Zr_2\ Co_{18}B_{1.8}\ N_7\ O_{0.007}\ Fe_{bal.}$ | 666 | 0.66 | 65 |
| Comparative Example 3-3 | $Sm_6\ Ce_2\ Nd_1\ Zr_2\ Co_{18}B_{1.8}\ N_7\ O_{0.008}\ Fe_{bal.}$ | 710 | 0.65 | 80 |
| Comparative Example 3-4 | $Sm_6\ Ce_2\ Nd_1\ Zr_2\ Co_{18}B_{1.8}\ N_8\ O_{0.009}\ Fe_{bal.}$ | 701 | 0.68 | 78 |
| Comparative Example 3-5 | $Sm_6\ Ce_2\ Nd_1\ Zr_2\ Co_{18}B_{1.8}\ N_7\ O_{0.009}\ Fe_{bal.}$ | 653 | 0.65 | 62 |
| Comparative Example 4-1 | $Sm_6\ Ce_2\ Nd_1\ Zr_2\ Co_{18}B_{1.7}\ N_8\ O_{6.1}\ Fe_{bal.}$ | 495 | 0.48 | 29 |
| Comparative Example 4-2 | $Sm_6\ Ce_2\ Nd_1\ Zr_2\ Co_{18}B_{1.7}\ N_8\ O_{6.0}\ Fe_{bal.}$ | 508 | 0.48 | 30 |
| Comparative Example 4-3 | $Sm_6\ Ce_2\ Nd_1\ Zr_2\ Co_{18}B_{1.7}\ N_8\ O_{5.1}\ Fe_{bal.}$ | 605 | 0.50 | 33 |
| Comparative Example 4-4 | $Sm_6\ Ce_2\ Nd_1\ Zr_2\ Co_{18}B_{1.7}\ N_8\ O_{5.9}\ Fe_{bal.}$ | 453 | 0.45 | 22 |
| Comparative Example 4-5 | $Sm_6\ Ce_2\ Nd_1\ Zr_2\ Co_{18}B_{1.7}\ N_7\ O_{6.5}\ Fe_{bal.}$ | 550 | 0.49 | 35 |

TABLE 3

| | Permanent magnetic material composition (bal. denotes balance) | Coersive force (kA/m) | Residual magnetic flux density (T) | Maximum energy product ($kJ/m^3$) |
|---|---|---|---|---|
| Example 3-1 | $Sm_7$ $Nd_1$ $Zr_1$ $Hf_1$ $Co_{22}Ga_1$ $B_{1.2}$ $N_7$ $O_{0.8}$ $Fe_{bal.}$ | 638 | 0.68 | 78 |
| Example 3-2 | $Sm_7$ $Nd_1$ $Zr_1$ $Hf_1$ $Co_{22}Ga_1$ $B_{1.2}$ $N_7$ $O_{1.0}$ $Fe_{bal.}$ | 629 | 0.68 | 77 |
| Example 3-3 | $Sm_7$ $Nd_1$ $Zr_1$ $Hf_1$ $Co_{22}Ga_1$ $B_{1.2}$ $N_7$ $O_{0.9}$ $Fe_{bal.}$ | 640 | 0.70 | 79 |
| Example 3-4 | $Sm_7$ $Nd_1$ $Zr_1$ $Hf_1$ $Co_{22}Ga_1$ $B_{1.2}$ $N_8$ $O_{0.9}$ $Fe_{bal.}$ | 635 | 0.67 | 77 |
| Example 3-5 | $Sm_7$ $Nd_1$ $Zr_1$ $Hf_1$ $Co_{22}Ga_1$ $B_{1.2}$ $N_8$ $O_{1.1}$ $Fe_{bal.}$ | 630 | 0.70 | 76 |
| Example 4-1 | $Sm_8$ $Gd_1$ $Zr_2$ $Co_{10}Al_1$ $B_{1.0}$ $N_8$ $O_{0.2}$ $Fe_{bal.}$ | 625 | 0.67 | 75 |
| Example 4-2 | $Sm_8$ $Gd_1$ $Zr_2$ $Co_{10}Al_1$ $B_{1.0}$ $N_9$ $O_{0.9}$ $Fe_{bal.}$ | 628 | 0.65 | 74 |
| Example 4-3 | $Sm_8$ $Gd_1$ $Zr_2$ $Co_{10}Al_1$ $B_{1.0}$ $N_8$ $O_{0.5}$ $Fe_{bal.}$ | 622 | 0.68 | 75 |
| Example 4-4 | $Sm_8$ $Gd_1$ $Zr_2$ $Co_{10}Al_1$ $B_{1.0}$ $N_8$ $O_{0.3}$ $Fe_{bal.}$ | 624 | 0.67 | 78 |
| Example 4-5 | $Sm_8$ $Gd_1$ $Zr_2$ $Co_{10}Al_1$ $B_{1.0}$ $N_8$ $O_{0.8}$ $Fe_{bal.}$ | 627 | 0.67 | 79 |
| Example 5-1 | $Sm_5$ $Nd_3$ $Zr_2$ $Co_9$ $Ni_3$ $Cu_1$ $B_{1.3}$ $P_{0.1}$ $N_9$ $O_{1.2}$ $Fe_{bal.}$ | 558 | 0.77 | 80 |
| Example 5-2 | $Sm_5$ $Nd_3$ $Zr_2$ $Co_9$ $Ni_3$ $Cu_1$ $B_{1.3}$ $P_{0.1}$ $N_9$ $O_{0.8}$ $Fe_{bal.}$ | 550 | 0.75 | 77 |
| Example 5-3 | $Sm_5$ $Nd_3$ $Zr_2$ $Co_9$ $Ni_3$ $Cu_1$ $B_{1.3}$ $P_{0.1}$ $N_9$ $O_{1.3}$ $Fe_{bal.}$ | 549 | 0.78 | 81 |
| Example 5-4 | $Sm_5$ $Nd_3$ $Zr_2$ $Co_9$ $Ni_3$ $Cu_1$ $B_{1.3}$ $P_{0.1}$ $N_9$ $O_{0.5}$ $Fe_{bal.}$ | 553 | 0.74 | 79 |
| Example 5-5 | $Sm_5$ $Nd_3$ $Zr_2$ $Co_9$ $Ni_3$ $Cu_1$ $B_{1.3}$ $P_{0.1}$ $N_8$ $O_{1.2}$ $Fe_{bal.}$ | 555 | 0.76 | 77 |

As apparent from Tables 1 to 3, 5 bond magnets of examples 1 to 5 containing a permanent magnetic material of a 0.01 to 5 atomic % oxygen content have stable magnetic characteristics with large residual magnetic flux density, coersive force and maximum energy product with a small variation among the values.

On the other hand, 5 bond magnets of comparative example 1 of the composition substantially the same as example 1 except the oxygen content, that is, containing a permanent magnetic material of a less than 0.01 atomic % oxygen content, generate a large variation in characteristics among the magnets although they have magnetic characteristics similar to those of example 1. 5 bond magnets of comparative example 2 of the composition substantially the same as example 1 except the oxygen content, that is, containing a permanent magnetic material of a more than 5 atomic % oxygen content not only are inferior to example 1 in the magnetic characteristics but also generate a large variation in characteristics among the magnets.

Further, the bond magnets of comparative examples 3 and 4 of the composition substantially the same as example 2 except the oxygen content, that is, containing a permanent magnetic material of a less than 0.01 atomic % oxygen content, and containing a permanent magnetic material of a more than 5 atomic % oxygen content, respectively show the tendency similar to the bond magnets of comparative examples 1, 2.

(EXAMPLE 6)

5 kinds of cylindrical bodies comprising a bond magnet were produced by adding 2% by weight of an epoxy resin to permanent magnetic materials of a composition the same as examples 1 to 5 shown in Tables 1 to 3, mixing, compression-molding at 1000 MPa, and curing at 150° C. for 2.5 hours. Cylindrical bodies comprising the bond magnets were divided into a plurality of arcs of a predetermined angle, having the N and S poles in the thickness direction by the polarization, arranged with the N and S poles of the adjacent arc portions alternately. 5 kinds of rotors were produced by fixing a disk having a spindle at an opening portion at one end of the cylindrical bodies, with the spindle projecting concentrically to the inside of the cylindrical bodies. Spindle motors were assembled by providing an electromagnet in the cylindrical bodies, pivoted by the spindle as well as supported by another supporting member but the cylindrical body.

In the obtained spindle motors, the cylindrical bodies can rotate by switching the N and S poles of the electromagnets provided in the cylindrical bodies comprising the bond magnets by the magnetization function, and as a result, the spindles projecting from the disk fixed at the cylindrical bodies can rotate at a high speed.

As heretofore mentioned, the present invention can provide a permanent magnetic material having a $TbCu_7$ phase as the principal phase with high magnetic characteristics with an extremely small variation among the values.

Further, the present invention can provide, a stable bond magnet containing the permanent magnetic material and a binder, having high magnetic characteristics.

Furthermore, the present invention can provide a motor comprising the above-mentioned bond magnet, in particular, a high performance spindle motor effective as the driving source for a hard disk drive or a CD-ROM can be provided.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A permanent magnetic material which is expressed in a general formula:

$$R1_xR2_yA_zO_uB_vM_{100-x-y-z-u-v}$$

wherein R1 is at least one element selected from the rare earth elements including Y, R2 is at least one element selected from Zr, Hf and Sc, A is at least one element selected from hydrogen, nitrogen, carbon and phosphorus, M is at least one element selected from Fe and Co, x, y, z, u and v are atomic percent individually defined as $2 \leqq x$, $0.01 \leqq y$, $4 \leqq x+y \leqq 20$, $0.001 \leqq z \leqq 10$, $0.01 \leqq u \leqq 2$, $0 < v \leqq 10$, and a principal phase has a $TbCu_7$ crystal structure.

2. The permanent magnetic material according to claim 1, wherein the ratio c/a of the lattice constants, a, c of the principal phase is 0.847 or more.

3. The permanent magnetic material according to claim 1, wherein the principal phase has a content ratio which comprises at least 50% by volume of the compound.

4. The permanent magnetic material according to claim 1, wherein the element R1 in said general formula contains Sm in an amount of 50 atomic % or more based on a total amount of the element R1, with the remaining portion excluding Sm and comprises at least one element selected from the group consisting of Pr, Nd and Ce.

5. The permanent magnetic material according to claim 1, wherein M is contained in the principal phase in an amount of 90 atomic percent or more based on a total amount of said principal phase.

6. The permanent magnetic material according to claim 1, wherein x in said general formula is defined by $4 \leqq x \leqq 16$.

7. The permanent magnetic material according to claim 1, wherein y in said general formula is defined by $0.1 \leqq y$.

8. The permanent magnetic material according to claim 1, wherein z in said general formula is defined by $2 \leqq z \leqq 20$.

9. The permanent magnetic material according to claim 1, wherein u in said general formula is defined by $0.1 \leqq u \leqq 1.5$.

10. The permanent magnetic material according to claim 1, wherein v in said general formula is defined by $0.01 \leqq v \leqq 4$.

11. The permanent magnetic material according to claim 1, wherein M in said general formula is partly replaced by T in amount of 20 atomic percent or less, wherein T is at least one element selected from the group consisting of Si, Ti, Al, Ge, Ga, V, Ta, Mo, Nb, Sn, Cr, W, Mn, Cu, Ag and Ni.

12. A bond magnet comprising:

permanent magnetic material expressed in a general formula:

$$R1_xR2_yA_zO_uB_vM_{100-x-y-z-u-v}$$

wherein R1 is at least one element selected from the rare earth elements including Y, R2 is at least one element selected from Zr, Hf and Sc, A is at least one element selected from hydrogen, nitrogen, carbon and phosphorus, M is at least one element selected from Fe and Co, x, y, z, u and v are atomic percent individually defined as $2 \leqq x$, $0.01 \leqq y$, $4 \leqq x+y \leqq 20$, $0.001 \leqq z \leqq 10$, $0.01 \leqq u \leqq 2$, $0 < v \leqq 10$, and a principal phase has a $TbCu_7$ crystal structure; and a binder.

13. The bond magnet according to claim 12, which is used as a part of at least one member selected from a rotor and a stator of a motor.

* * * * *